US009193204B2

(12) United States Patent
Dinescu et al.

(10) Patent No.: US 9,193,204 B2
(45) Date of Patent: Nov. 24, 2015

(54) HEAT TRANSFERS SUITABLE FOR APPLICATION ON DYE SUBLIMATION APPAREL

(71) Applicant: Avery Dennison Retail Information Services LLC, Mentor, OH (US)

(72) Inventors: Liviu Dinescu, Chatsworth, CA (US); Osman Tanrikulu, Denver, CO (US); Cary Moore, Lenoir, NC (US)

(73) Assignee: Avery Dennison Corporation, Glendale, CA (US)

( * ) Notice: Subject to any disclaimer, the term of this patent is extended or adjusted under 35 U.S.C. 154(b) by 33 days.

(21) Appl. No.: 14/012,970

(22) Filed: Aug. 28, 2013

(65) Prior Publication Data

US 2015/0064372 A1 Mar. 5, 2015

(51) Int. Cl.

| | |
|---|---|
| ***B41M 5/382*** | (2006.01) |
| ***B41M 5/42*** | (2006.01) |
| ***A41D 27/08*** | (2006.01) |
| ***G09F 3/00*** | (2006.01) |

(52) U.S. Cl.

CPC ..... *B41M 5/42* (2013.01); *A41D 27/08* (2013.01); *B41M 5/38214* (2013.01); *G09F 3/00* (2013.01); *B41M 2205/02* (2013.01); *B41M 2205/30* (2013.01); *B41M 2205/38* (2013.01)

(58) Field of Classification Search

CPC ..... B41M 5/382; B41M 5/38214; B41M 5/42
USPC ..... 503/227; 8/471; 428/32.79
See application file for complete search history.

(56) References Cited

U.S. PATENT DOCUMENTS

| | | | | |
|---|---|---|---|---|
| 7,238,644 | B2 * | 7/2007 | Yukawa et al. | 503/227 |
| 7,709,417 | B2 | 5/2010 | Yukawa | |
| 8,349,427 | B2 | 1/2013 | Grotefend | |
| 8,859,461 | B2 * | 10/2014 | Kuwahara | 503/227 |
| 2005/0100689 | A1 | 5/2005 | He et al. | |
| 2011/0079651 | A1 | 4/2011 | Tsai et al. | |
| 2012/0040154 | A1 * | 2/2012 | Dinescu et al. | 428/200 |
| 2012/0121869 | A1 | 5/2012 | Kuwahara | |

(Continued)

FOREIGN PATENT DOCUMENTS

| | | |
|---|---|---|
| JP | 4146565 | 9/2008 |
| WO | 2010075436 | 7/2010 |
| WO | 2010113145 | 10/2010 |

OTHER PUBLICATIONS

International Search Report dated Nov. 25, 2014 and Written Opinion for International Application No. PCT/US2014/053047.

(Continued)

*Primary Examiner* — Bruce H Hess
(74) *Attorney, Agent, or Firm* — Avery Dennison Retail Information Services LLC

(57) ABSTRACT

Heat transfers are provided that have indicia for enhancing the appearance of color dye sublimated fabric material, such as apparel and accessories including sportswear fabrics. The label assembly includes a transfer portion protected by a releasable support portion. The transfer portion includes a multi-layer barrier containing at least two differently formulated barrier layers. The second such barrier layer extends outwardly beyond the perimeter edge of the first barrier layer, which perimeter edge had left a recess gap in the transfer portion, which recess gap is covered by the overhang margin of the second barrier layer.

19 Claims, 1 Drawing Sheet

(56) References Cited

U.S. PATENT DOCUMENTS

| | | | |
|---|---|---|---|
| 2012/0141698 | A1 | 6/2012 | OLeary |
| 2013/0160193 | A1 | 6/2013 | Cremin |

OTHER PUBLICATIONS

Velflex Subblock Product Sheet, retrieved from the internet: http://velflex.s3-ap-southeast-2.amazonaws.com/pdfs/PrintableFilm/3/Velflex_Subblock_Product_Sheet.pdf?_sm_au_=iVVF7nrVrqssTrnQ.

Avery Dennison® Dye Block & Agility™ Stretchable Blocking Black Product Sheet and Technical Information, retrieved from the internet: http://rbis.averydennison.com/content/dam/averydennison/rbis/global/en/product-families/Heat-Transfers/docs/DyeBlockAgility-product-information-v1.pdf.

RTAPE—Heat Pressing on Dye Sublimated Fabrics, retrieved from the internet: http://www.rtape.com/blog-post/heat-pressing-on-dye-sublimated-fabrics, published Nov. 27, 2012.

Activated Carbon Basics, retrieved from the internet: http://norit-americas.com/activated-carbon/activated-carbon-basics [retrieved Aug. 25, 2011.

Product Specification for Expancel® Microspheres Issue 2014.12, https://www.akzonobel.com/expancel/system/Images/AkzoNobel_Expancel_WU_product_specification_tcm65-55927.pdf.

IMPRANIL®—Aqueous pur dispersions for textile coatings, retrieved form the internet: http://virtualpu.com/uploads/user_product_attachments/0-2014-06-11%2015:41:27-Dispersionen_GB_final_090311_S30-31.pdf.

* cited by examiner

HEAT TRANSFERS SUITABLE FOR APPLICATION ON DYE SUBLIMATION APPAREL

BACKGROUND

1. Field of the Disclosure

The present subject matter relates to heat transfers that feature anti-dye migration enhancements, particularly for use on color dye sublimated apparel such as sportswear fabrics, clothing and accessories. The present subject matter is especially suitable for transfers having a color ink layer protected by a support sheet suitable for use in heat-transferable labeling and the like.

2. Description of Related Art

Transfer decoration, labels, patches, tags, identification placards, embellishments and the like are widely used for a variety of different applications including logos, trademarks, keyboard symbols, whether numeric, alphabetic or alphanumeric or other symbols, sports designs, logos and names, clothing design details, accents and backgrounds, artwork and the like. In some applications, these decorative components are in the nature of heat transfer labels suitable for application on color dye sublimated fabrics, clothing and accessories. Such decorative components often concern so-called "soft goods," a term generally understood in the art. Examples include clothing, upper bodywear, lower bodywear, headwear, footwear, outerwear, underwear, garments, sportswear fabrics, other sheet goods, banners, flags, athletic or sport clothing and uniforms, government uniforms, organization uniforms, accessories (e.g. belts, hats, scarves, etc.) therefor and combinations thereof.

Production of such soft goods or the like can include the use of dye sublimation techniques for fabrics. It is recognized that dye sublimated fabrics are remarkable due to their vivid color appearance, while being flexible in process manufacturing. These can be referred to as sublimated fabrics, which typically use heat-resistant synthetic fabrics that allow dyes of the "disperse dye" category to diffuse in the fabric fibers when subjected to heat. Typical synthetic fibers suitable for such a dye diffusion approach include polyesters, polyamides, nylons, and combinations of such materials with cotton and/or stretchable or resilient materials such as spandex or elastane or Lycra® and the like. Sublimated fabrics are a particular challenge for heat transfer labels, the significant challenge being that diffusion-driven dyes have a tendency to migrate from the base fabric and can migrate to and through the transfer or label, thereby altering its face color or intended appearance as well as impacting or damaging the appearance of the surrounding fabric. It is believed that the dye diffusion process is thermodynamically driven by the dye concentration gradient and that same is facilitated by heat encountered from a variety of sources during manufacture and use.

The art has recognized that this problem can be addressed through the use of anti-dye migration techniques. Such techniques can include the use of a so-called barrier layer that is often positioned in contact with the label or heat transfer when applied to the fabric. Often dye migration resistant heat transfers or labels feature a barrier layer based on highly chemically absorbent materials such as activated carbon. Even with such advances, dye diffusion often occurs along the outer perimeter of the heat transfer or label, creating what is at times referred to as the "halo effect" creating an undesirable ring around the outside of the transfer.

Following are examples of previous attempts to solve the "halo effect" problem. U.S. Patent Application Publication No. 2012/0121869 includes a dye migration preventing layer in a decoration piece, this layer being arranged between the decoration piece and the lower layer typical for such a decoration piece that can take the form of an emblem, badge, appliqué, sticker or the like. Such a decoration piece when used is attached to polyester fabric such as clothing dyed by using dispersion dye or sublimation printing. One of the features of this approach is to insure the dye migration preventing layer has an outer profile that is the same as that of the decoration or design piece.

Dinescu et al. U.S. Patent Publication No. 2012/0040154 combines a breathability feature with heat transfer labels that include a dye blocking layer as well as a so-called white layer, along with a clear layer, this labeling approach being intended for fabric containing thermal sublimation dyes. This recognizes that a thermal sublimation dye will migrate through the adhesive layer on which the label is attached to the fabric and into the white layer or the indicia layer when heated, such as during thermal transfer processing, which can cause the color of the white layer or the indicia layer to be contaminated. By this approach, the dye blocking layer is provided in an effort to stop the thermal sublimation dye from contaminating the white layer or the indicia layer. Such dye barriers include the use of activated carbon.

U.S. Pat. No. 7,238,644 concerns a laminate for printing in order to color a resin layer by allowing a sublimable dyeing agent to permeate into the inside of a resin layer through heating. This laminate includes an inner layer that is a coloring resin layer having strong affinity with a sublimable dyeing agent in an attempt to prevent transfer of the dyeing agent and of the sublimable dyeing agent having been printed.

FIG. 1 illustrates a typical prior art transfer or heat transferable label assembly that incorporates a barrier layer. This transfer includes a support portion, generally designated at 21, releasably secured to a transfer label portion, generally designated at 22. A release layer 23 overlies a carrier layer 24 of the support. A color ink layer 25 of the transfer is applied over a so-called white ink layer 26, positioned between the color ink layer and an adhesive layer 27. The barrier layer 28 is positioned between a substantial portion of the interface between the white ink layer and adhesive layer, with the barrier layer being spaced inwardly from the edge of the label in order to avoid visual detection of the activated carbon-based barrier 28 outside of the white background layer.

SUMMARY

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as may be set forth in the claims appended hereto.

In one aspect of this disclosure, a heat transferable label is provided that has a support portion releasably secured to a transfer portion. The transfer portion includes a color ink layer with a decorative face opposite the releasably secured support portion, a multi-layer barrier having a first barrier layer with a first perimeter, the first barrier layer overlying the color ink layer, and a second barrier layer overlying the first barrier layer and having a second perimeter extending beyond the first perimeter to provide an overhang with respect to the first barrier layer. A hot melt adhesive layer overlies the second barrier layer of the multi-layer barrier.

In another aspect, of this disclosure, a heat transferable label is provided that has a support portion releasably secured to a transfer portion. The transfer portion includes a color ink layer with a decorative face opposite the releasably secured support portion, a transition layer overlying the color ink layer, the transition layer having a third perimeter, a multi-layer barrier having a first barrier layer with a first perimeter, the first barrier layer overlying the color ink layer, and a second barrier layer overlying the first barrier layer and having a second perimeter extending beyond the first perimeter to provide an overhang with respect to the first barrier layer. A hot melt adhesive layer overlies the second barrier layer of the multi-layer barrier.

In a further aspect of this disclosure, a heat transferable label is provided that has a support portion releasably secured to a transfer portion. The transfer portion includes a color ink layer with a decorative face opposite the releasably secured support portion, a white ink layer overlying the color ink layer and having a fourth perimeter, a multi-layer barrier having a first barrier layer with a first perimeter, the first barrier layer overlying the color ink layer, and a second barrier layer overlying the first barrier layer and having a second perimeter extending beyond the first perimeter to provide an overhang with respect to the first barrier layer. A hot melt adhesive layer overlies the second barrier layer of the multi-layer barrier.

In an added aspect of this disclosure, a heat transferable label is provided that has a support portion releasably secured to a transfer portion. The transfer portion includes a color ink layer with a decorative face opposite the releasably secured support portion, a white ink layer overlying the color ink layer and having a fourth perimeter, a multi-layer barrier having a first barrier layer with a first perimeter, the first barrier layer overlying the color ink layer, and a second barrier layer overlying the first barrier layer. A hot melt adhesive layer overlies the second barrier layer of the multi-layer barrier and has a third perimeter extending beyond the first perimeter, thereby defining a recess gap at the perimeter edge of the first barrier layer. The second barrier layer has a second perimeter extending beyond the first perimeter to provide an overhang margin with respect to the first barrier layer, which overhang margin lies within the recess gap.

In an additional aspect, the disclosure relates to a transfer for application to color dye sublimated sportswear fabrics, the transfer including a support sheet releasably secured to a transfer label having a color ink layer with a decorative face opposite the releasable support sheet, an intermediate layer and an adhesive layer on the outside face, the disclosure including the placement of the multi-layer barrier between the intermediate layer and the adhesive layer.

Other features and advantages of the present invention will become apparent to those skilled in the art from the following detailed description. It is to be understood, however, that the detailed description of the various embodiments and specific examples, while indicating preferred and other embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

These as well as other objects and advantages of this invention, will be more completely understood and appreciated by referring to the following more detailed description of the presently preferred exemplary embodiments of the invention in conjunction with the accompanying drawings, of which.

DESCRIPTION OF THE ILLUSTRATED EMBODIMENTS

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner.

Figure 1:
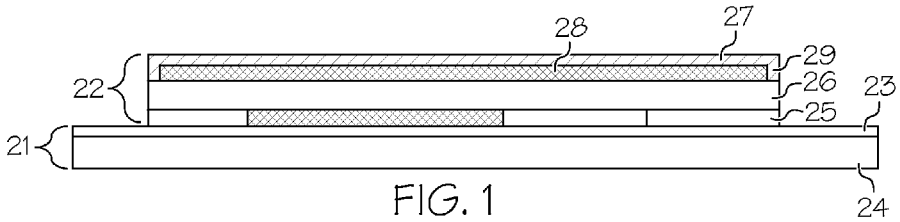
FIG. 1 is a schematic illustration showing multiple layers of a typical prior art transfer.

With further reference to the typical prior art transfer that is illustrated in FIG. 1, an important element of the present disclosure is its recognition that the need to prevent visual detection of the dark barrier layer 28 can be a cause of the halo effect discussed herein. The barrier smaller perimeter 29 is provided in order to allow the intentionally visible layers 25, 26 to fully cover the barrier layer or to provide a relationship of the layers so that the barrier layer is "hidden" or recessed from the white ink layer and color ink layer so it cannot be seen outside of the white background layer. Such a smaller perimeter 29 typically is relatively small, usually no more than 0.5 mm and usually at least 0.1 mm. A general target range for the same is between about 0.1 and about 0.3 mm, which can be considered to be a tolerance range around what is an ideal width of 0.2 mm. Despite the provision of the barrier layer, this prior art approach is inconsistent in its prevention of the halo effect.

Figure 2:
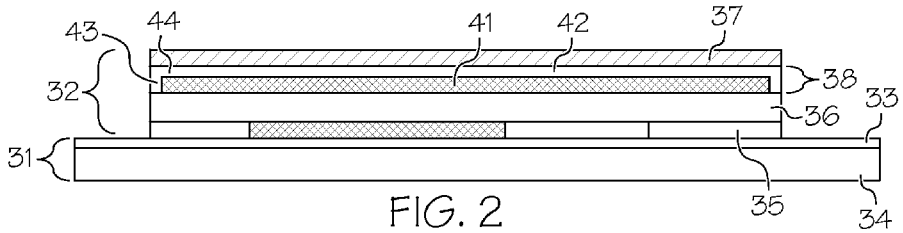
FIG. 2 is a schematic illustration showing multiple layers of a first embodiment according to the present disclosure.

FIG. 2 follows what can be considered to be a multi-layer barrier approach and provides a first embodiment that much more successfully and consistently eliminates the halo effect. A support portion, generally designated at 31, and a transfer portion, generally designated at 32, form the transfer or label of this embodiment. Included in the support portion is a release layer 33 and a carrier layer 34. Included in the transfer portion is a color ink layer 35, a white ink layer 36, an adhesive layer 37, and a multi-layer barrier, generally designated as 38.

With further reference to the multi-layer barrier 38, same includes a first barrier layer 41 and a second barrier layer 42. In this illustrated embodiment, the first barrier layer is printed to include a recess gap 43. The second barrier layer cooperates with this structure by being printed with a perimeter margin or overhang 44, thereby providing the second barrier layer with an area size and shape that is the same as, or slightly in excess of, the white color layer so that the white color layer 36 is coincident in size and shape or is slightly overlapped by the size and shape of the second barrier layer 42. Where the size of the second barrier layer 42 is larger so as to create this type of overhang margin 44, the width of the overhang should be no greater than 0.2 mm in excess of the perimeter size and shape of the first barrier layer 41.

Figure 3:
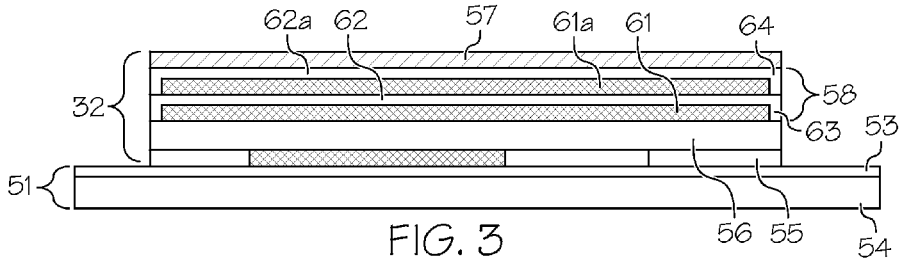
FIG. 3 is a schematic illustration showing multiple layers of a second embodiment according to the present disclosure.

The second embodiment illustrated in FIG. 3 varies from the first embodiment by including additional, essentially repeating barrier layers. More particularly, FIG. 3 depicts a transfer having support portion 51 and transfer portion 52. As with the other embodiments, support portion 51 includes a release layer 53 and a carrier layer 54. Release layer 53 is in facing, releasable relationship with color ink layer 55 which is printed over white ink layer 56. Multi-layer barrier 58 is between the white color layer 56 and adhesive layer 57.

With more particular reference to the multi-layer barrier 58, same includes alternating sequences of first and second barrier layers. This repetitive approach has the advantage that each barrier layer can be thinner, allowing more flexing inasmuch as the more stretchable polymers of the first barrier layer can compensate for what is a thinner more rigid second barrier. As discussed herein, the polymer film of the first barrier layer typically is more flexible than the polymer film of the second barrier layer. This repeating-layers approach allows the second barrier layer to be thinner than when only a single first and second barrier layer pair are provided, as in the embodiment of FIG. 2.

More than the illustrated two pairs of first barrier layers 61, 61*a* and second barrier layers 62, 62*a* can be provided. For example, the embodiment can have up to ten first and second barrier layer pairs sandwiched on top of each other. However many the number of pairs, the diffusing dyes need to pass through a multitude of absorb and defect sequences before any halo effect appearances. Generally, each pair of first and second barrier layers is configured to provide a recess gap 63 and an overhang margin 64 substantially as provided in the first embodiment depicted in FIG. 2.

Figure 4:
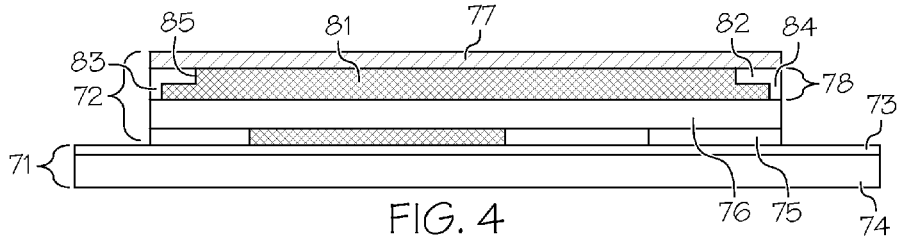
FIG. 4 is a schematic illustration showing multiple layers of a third embodiment according to the present disclosure.

The transfer construction of the third embodiment that is illustrated in FIG. 4 includes support portion 71 with release layer 73 and carrier layer 74, releasably secured to the transfer portion 72. A color ink layer 75 is printed over a white ink layer 76, which is printed over a multi-layer barrier 78, which is printed over an adhesive layer 77. Printing of the color ink layer 75 can be accomplished through a number of different printing techniques, such as screen printing, flexographic printing, digital printing or any other suitable printing means.

With more particular reference to the multi-layer barrier 78, the second barrier layer 82 does not cover the entire area of the first barrier layer 81; instead, the second barrier layer has what might be considered to be an inside wall 83 that defines a void in the second barrier layer 82. In the case of a transfer that is circular in plan view, the second barrier layer 82 takes the form of an edge ring having an overhang margin 84 that fills recess gap 83 defined along the perimeter of the first barrier layer 81 that is smaller than the extreme periphery of the white ink layer 76. In this illustrated embodiment, the first barrier layer 81 fills the void defined by the inside wall 85 of the second barrier layer 82. This thicker portion of the first barrier layer 81 does not detrimentally affect flexibility and bendability of the transfer of this third embodiment since the polymer of the first barrier layer exhibits flexibility and/or stretchability in excess of that of the polymer of the second barrier layer 82, a substantial portion of which is in effect replaced by polymer of the first barrier layer 81.

Figure 5:
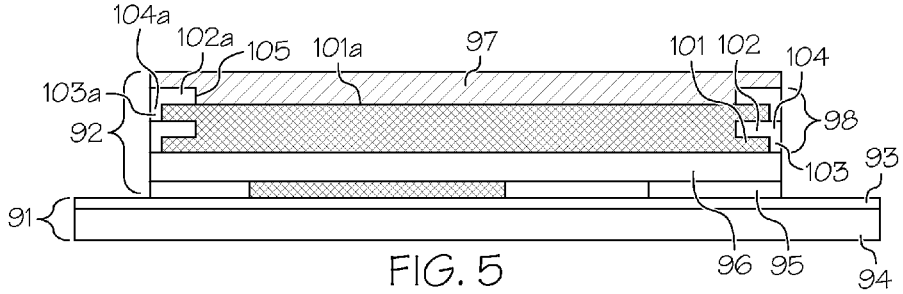
FIG. 5 is a schematic illustration showing multiple layers of a fourth embodiment according to the present disclosure.

FIG. 5 illustrates a fourth embodiment according to the present disclosure wherein a support portion 91, having a release layer 93 and a carrier layer 94, is releasably secured to transfer portion 92. A color ink layer 95 and a white ink layer 96 are provided generally in line with the other embodiments illustrated herein. One can consider this fourth embodiment to be a conceptual combination of the second embodiment with the third embodiment. A multi-layer barrier 98 is positioned between the white ink layer and adhesive layer 97.

The structure and relationship between first barrier layer 101 and second barrier layer 102 is substantially the same as that for first barrier layer 81 and second barrier layer 82 in FIG. 4. Recess gap 103 of the first barrier layer 101 accommodates overhang margin 104 of the second barrier layer 102. First barrier layer 101*a* also has a recess gap 103*a*. As depicted, the second barrier layer 102*a* has an overhang margin 104*a* functioning as generally described herein. In the particular arrangement shown in FIG. 5, the second barrier layer 102*a*, similar to second barrier 82 of FIG. 4, has an inside wall 105, leaving a void interior of the second barrier layer 102*a*. In this particular embodiment, the void is filled by adhesive 97, which tends to increase flexibility as generally discussed herein due to reduction in the volume of the polymer in the second barrier layer 102*a*. Instead, the second barrier layer 102*a* can omit the void, providing a second barrier layer more in line with second barrier layer 42 of FIG. 2.

It will be appreciated that the specific embodiments illustrated herein can be supplemented, particularly with respect to a transfer portion that can be considered a heat transfer label composed of a series of sandwiched layers. These layers can include the color art design layer, or color heat layer depicted in the drawings, which provides the artwork or other indicia or coloration or design that identifies the particular label. A background layer or transition layer such as the white ink layers described herein typically is included to provide background attributes to the color art design layer. One or more clear layers can be included for reasons generally known in the art. Functional layers such as the adhesive layers and barrier layers shown and described herein are included. This transfer or heat transfer label is transferrable onto a fabric support upon heat and pressure application in the manner known in the art.

In order to facilitate protection and delivery of the transfer portion of the label, a support portion typically is provided which has the function of a label carrier that provides mechanical strength to the label assembly allowing handling such as being wound up in a roll for storage, stacking, and as a label feed for mechanized operations. Basically, the support portion is a sheet carrier and a release layer. Typical sheet carriers are cellulosic or polymeric film. A typical release layer is a low melting temperature, thinly coated film on a sheet carrier that facilitates peeling of the transfer portion from the sheet carrier when the heat transfer is completed. An example of a carrier is an "O6" liner which is thermally stabilized polyethylene terephthalate (PET) of about 5 mil thickness coated with an amide wax-based heat-induced release layer, commercialized by Avery Dennison Retail Brand and Information Services Division (RBIS Division) of Westborough, Mass.

Concerning manufacture of label or transfer assemblies generally discussed herein, it is typical for each layer to be coated, typically printed, on top of a previous layer in order to form sandwich-type structures as shown in the drawings hereof. Generally, these layers are printed in reverse order, top to bottom, and typically the color ink or color art design layer is printed mirror imaged, left to right. Component layers in such sandwiches are polymeric films containing other ingredients such as color pigments, waxes, other polymers, additives, fillers and the like, generally discussed in greater detail herein. With further reference to the printing approach that is typically used in these instances, the layers are generated by printing inks that are subsequently cured and dried. Usually these inks are based on a water vehicle or a solvent vehicle that is dispersed or dissolved in one or several components such as polymers, additives, pigments, ink additives and the like. Examples of ink additives in this regard include humectants, rheology modifiers, surface tension modifiers, leveling agents, release agents, and so forth.

Also used in the manufacture of these labels typically are color layers and precursor inks, often water and solvent-based screen inks. Examples of a suitable such inks are those based on polyurethane polymers, a specific screen ink being AGILITY™ color screen set available from Avery Dennison (RBIS Division). Regarding the first dye barrier layers described herein, each is based on a polymeric media that is incompatible or partially compatible with the dispersed dyes used by color sublimation techniques. Usually such polymeric media contain additives or fillers that are able to adsorb effectively the dye molecules. As generally discussed herein, absorbent fillers of this type may exhibit a color, typically a dark color, that causes concern for placement of such barriers in the label assembly.

Examples of polymers for the first barrier layer are solvent-based or water-based polyurethanes exhibiting good elastic and stretch properties, for example having an elongation at break of better than 100 percent. These polymers typically are of a relatively high molecular weight, in excess of 100,000, exhibit good mechanical properties, such as tensile strength of greater than 10 MPa and a tensile strength of less than 60 MPa. Usually these suitable polymers for the first barrier layer have a melt range of greater than 150° C., often of 175° C. or greater. An example of a suitable polymer in this regard is IMPRANIL® DLU, which is a water-based polyurethane derived from a polyether and polycarbonate diols.

Fillers suitable for the first barrier layer are highly adsorbent, such as activated carbons and composites between activated carbon and molecular sieves. Activated carbon is known to remove impurities from fluids, whether liquid or gaseous, by a process called adsorption. In this context, adsorption is a surface phenomenon that results in the accumulation of molecules on the surface of the internal pores of an activated carbon. Suitable activated carbons for this purpose have a surface area in the range of 600 to 1600 square meters per gram and a total pore volume between 0.9 and 1.8 Ml/g. An especially suitable particle size range is between 0.5 and 80 microns, an even more suitable range being between 1 and 50 microns, an especially suitable range being between 5 and 20 microns.

Ink barriers of the type described herein for the first dye barrier may contain additives such as thickeners, surfactants, dispersants, cross-linkers, and so forth. In terms of additive choice, preference is given to those that are polymeric or contain molecules much larger than the average pore dimension of the carbon, so they will not be adsorbed and render the activated carbon ineffective. As an example, IMPRANIL® DLU used as a binder has a high molecular weight and good mechanical properties and thus would not require cross-linking with small reactive species that would contaminate the adsorbent coating material.

The first barrier layer of the present embodiments can have thicknesses varying between about 5 and about 500 microns. A more specific suitable range is between about 10 and about 200 microns, with an especially suitable range being between about 15 and about 100 microns. The second layer of the multi-layer dye barrier described herein is based on a polymeric media that is incompatible with the chemical nature of dispersed dyes used in sublimation coloring of textiles and the like. Compatibility or incompatibility between a polymer and a small molecular species such as a solvent or a dye can be measured according to the Hildebrand solubility parameter expressed in $(\text{calories/cm}^3)^{1/2}$, and requires comparable values of this property between the polymer and the solvent. Varied properties exhibited by the polymeric layer are expressed by the amount of containment or chemical migratory species that penetrate the layer per unit time and area.

Although useful in assessing the polymer/solvent interaction, the solubility parameters cannot be applied accurately to polar polymers and small organic molecules. Other useful measures of barrier properties for polymers are density and melt point (Tg, crystallinity). Generally, the higher these properties, the better the dye barrier properties that are manifested. One polymer useful for the second barrier layers described herein is polyvinylidyene chloride (PVDC), same being a homopolymer of vinylidene chloride, which exhibits outstanding barrier properties against water, oxygen and other chemical species. The particular polyvinylidyene chloride particularly useful as the second barrier layer polymer has a melting point of 202° C. and a Tg of −17° C., while the density at 25° C. ranges between 1.67 and 1.97 g/cm$^3$, depending on crystalinity. Other polymers derived from vinylidene chloride can be useful. Other polymers for the second barrier layer include copolymers of vinylidene dichloride with acrylic and vinyl monomers, such as: methylmethacrylate, methylacrylate, butylacrylate and methacrylate, as well as acrylonitrile, acrylics acid, methacrylic acid, among others. Printing approaches for applying this second barrier layer to the label assembly is by printing, such as by screen printing, although other printing and coating methods are also possible, for example: graveure, flexography, offset printing, coating using a slot die, Meyer rod, digital printing, lamination and so forth.

These polymers used for the second barrier layer are suitable in the form of water-based emulsions with solid contents of 30-60 percent. Polymers of this type are made of inks and mixed with other components such as fillers, pigments and additives such as other barrier components, rheology modifiers, surfactants and so forth. Additives particularly suitable include EXPANCEL® microspheres from Akzo Nobel. Such microspheres in the second barrier layer increase not only the diffusion path of a migratory dye, but also improve softness and flexibility of rigid barrier polymers such as PVDC. These types of microspheres are dispersions of gas-filled polymeric microcapsules. Examples of suitable grades for such microcapsules are known as WU and WE. In an especially suitable combination, the microspheres should contain polymeric microcapsule walls made of PVDC and/or its copolymers. Suitable particle sizes for unexpanded EXPANCEL® microspheres range from about 6 to about 15 microns, with onset for expansion temperature range being from 80 to 120° C. A typical second dye barrier film will contain between about 1 to 20 percent of these microspheres, or between 2 and 10 percent, or between 3 and 7 percent.

Other additives for the second dye barrier film include high surface area inorganic fillers. These include amorphous silicas such as fumed silica with particles ranging from about 5 to about 50 microns and surface areas from between 10 and 1,000 m$^2$/g. Suitable silica additives of this type are available from Evonik-Degussa and under the AEROSIL® trademark and from Cabot under the CAB-O-SIL brand. When included, the second dye barrier film will contain 1 to 50 percent silicon, or 5 to 30 percent silica, or 5 to 20 percent of silica. Another effective filler category or molecular sieves can be, for example, zeolites. These are alumina silicates with natural or synthetic origins that are characterized by regular and repetitive atomic core structure. Especially suitable are zeolites with a pore diameter less than 13 Angstroms and a particle size distribution between 1 and 100, or 5 and 40, or 5 and 10 microns. An example of molecular sieves or zeolites for this purpose are SYLOSIL® from W.R. Grace Company.

It will be appreciated that, due in large measure to the nature of the fillers used in formulating this second dye barrier layer, the color of such layer, upon drying and curing, is white or is otherwise lightly colored. Optionally, pigment fillers such as titanium dioxide and optical brighteners can be added to enhance layer whiteness. The thickness of this second dye barrier layer ranges between 5 and 500 microns, typically between 10 and 200 microns, and most typically between 15 and 100 microns.

With further reference to the adhesive layer described in connection with the present embodiments, this has a modulus suitable to withstand high temperature wash tests such as those required by some apparel manufacturers. Adhesive also has to have suitable adhesion to synthetic fibers. Usually, the adhesive is continuously printed or flood coated to a thickness that can range between 20 and 500 microns. In most applications, the adhesive needs to melt and flow in the fabric texture at a temperature of between 250 and 350° F. (approximately 121 to 177° C.) when heated for 5 to 50 seconds.

An example of a commercial hot-melt adhesive suitable for this purpose is AGILITY® transfer adhesive, available from Avery Dennison (RBIS Division). In the approaches described herein, the adhesive margin is printed to match or exceed the largest margin of the color background layer or the second barrier layer.

Other embodiments, besides those illustrated herein, may also be employed without departing from the scope of the present disclosure. For example, the label can be of a perimeter shape desired for a particular purpose other than the generally circular or cylindrical labels associated with a patch or insignia, for example, taking the form of a decorative embellishment, company logo, or artwork. Other options include enhancing the flexibility of the label or the like by minimizing the thickness and area covered by the second barrier layer, thereby providing improved label performance in terms of being able to better follow bendability or flow of the substrate to which the label is attached, such as fabric or clothing.

It will be understood that the embodiments described above are illustrative of some of the applications of the principles of the present subject matter. Numerous modifications may be made by those skilled in the art without departing from the spirit and scope of the claimed subject matter, including those combinations of features that are individually disclosed or claimed herein. For these reasons, the scope hereof is not limited to the above description but is as set forth in the following claims, and it is understood that claims may be directed to the features hereof, including as combinations of features that are individually disclosed or claimed herein.

The invention claimed is:

1. A heat transferable label, comprising:

a support portion releasably secured to a transfer portion;

wherein the transfer portion includes:

a color ink layer with a decorative face opposite the releasably secured support portion;

a multi-layer barrier having a first barrier layer with a first perimeter, the first barrier layer overlies the color ink layer;

the multi-layer further including a second barrier layer having a second perimeter extending beyond the first perimeter to provide an overhang with respect to the first barrier layer, the second barrier layer overlying the first barrier layer; and an adhesive layer overlying the second barrier layer of the multi-layer barrier.

2. The heat transferrable label in accordance with claim 1, wherein the adhesive layer has a third perimeter extending beyond the first perimeter of the first barrier layer, thereby defining a recess gap at the perimeter edge of the first barrier layer.

3. The heat transferrable label in accordance with claim 2, wherein the overhang margin lies within the recess gap.

4. The heat transferrable label in accordance with claim 2, wherein the adhesive layer has an outside perimeter substantially same as the second perimeter of the second barrier layer.

5. The heat transferrable label in accordance with claim 1, further including a transition layer between the color ink layer and the multi-layer barrier, the transition layer having a fourth perimeter.

6. The heat transferrable label in accordance with claim 5, wherein the second perimeter of the second barrier layer is equal to or greater than said fourth perimeter.

7. The heat transferrable label in accordance with claim 1, wherein said color ink layer comprises decorative indicia for use on color dye sublimated apparel.

8. The heat transferrable label in accordance with claim 1, wherein said first barrier layer comprises a polymer film including additives selected from the group consisting of fillers, dye adsorbent pigment, and combinations thereof.

9. The heat transferrable label in accordance with claim 1, wherein said second barrier layer comprises a polymer film including microspheres and optionally fillers.

10. The heat transferrable label in accordance with claim 1, wherein said adhesive layer is a hot melt adhesive.

11. A heat transferable label, comprising:

a support portion releasably secured to a transfer portion;

wherein the transfer portion includes:

a color ink layer with a decorative face opposite the releasably secured support portion;

a transition layer overlying the color ink layer, the transition layer having a fourth perimeter;

a multi-layer barrier having a first barrier layer with a first perimeter, the first barrier layer overlies the transition layer;

the multi-layer further including a second barrier layer having a second perimeter extending beyond the first perimeter to provide an overhang with respect to the first barrier layer, the second barrier layer overlying the first barrier layer; and a hot melt adhesive layer overlying the second barrier layer of the multi-layer barrier.

12. The heat transferable label in accordance with claim 11, wherein the transition layer is a white ink layer.

13. The heat transferrable label in accordance with claim 12, wherein the adhesive layer has a third perimeter extending beyond the first perimeter of the first barrier layer, thereby defining a recess gap at the perimeter edge of the first barrier layer.

14. The heat transferrable label in accordance with claim 13, wherein the overhang margin lies within the recess gap.

15. The heat transferrable label in accordance with claim 13, wherein the adhesive layer has an outside perimeter substantially same as the second perimeter of the second barrier layer.

16. The heat transferrable label in accordance with claim 11, wherein the second perimeter of the second barrier layer is equal to or greater than said fourth perimeter.

17. A heat transferable label, comprising:

a support portion releasably secured to a transfer portion;

wherein the transfer portion includes:

a color ink layer with a decorative face opposite the releasably secured support portion;

a white ink layer overlying the color ink layer, the white ink layer having a fourth perimeter;

a multi-layer barrier having a first barrier layer with a first perimeter, the first barrier layer overlies the transition layer;

the multi-layer further including a second barrier layer having a second perimeter extending beyond the first perimeter to provide an overhang with respect to the first barrier layer, the second barrier layer overlying the first barrier layer; and a hot melt adhesive layer overlying the second barrier layer of the multi-layer barrier, the adhesive layer has a third perimeter extending beyond the first perimeter of the first barrier layer, thereby defining a recess gap at the perimeter edge of the first barrier layer.

18. The heat transferrable label in accordance with claim 17, wherein the overhang margin lies within the recess gap.

19. The heat transferrable label in accordance with claim 17, wherein the adhesive layer has an outside perimeter substantially same as the second perimeter of the second barrier layer.

* * * * *